US011304866B2

(12) United States Patent
Knecht et al.

(10) Patent No.: US 11,304,866 B2
(45) Date of Patent: Apr. 19, 2022

(54) HEAD OF BED ACCESS

(71) Applicant: Hill-Rom Services, Inc., Batesville, IN (US)

(72) Inventors: Michael Knecht, Batesville, IN (US); Jonathan D. Turner, Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 52 days.

(21) Appl. No.: 16/849,090

(22) Filed: Apr. 15, 2020

(65) Prior Publication Data

US 2020/0330302 A1 Oct. 22, 2020

Related U.S. Application Data

(60) Provisional application No. 62/835,266, filed on Apr. 17, 2019.

(51) Int. Cl.
*A61G 7/018* (2006.01)
*A61G 7/05* (2006.01)

(52) U.S. Cl.
CPC ..... *A61G 7/018* (2013.01); *A61G 7/0524* (2016.11)

(58) Field of Classification Search
CPC ..... A61G 7/018; A61G 7/0524; A61G 7/00; A61G 1/048
See application file for complete search history.

(56) References Cited

U.S. PATENT DOCUMENTS 5,069,465 A * 12/1991 Stryker ..... A61G 1/048 280/47.371
7,419,019 B1 * 9/2008 White ..... A61G 7/08 180/19.1
7,789,187 B2 * 9/2010 Zerhusen ..... A61G 1/0237 180/323

(Continued)

FOREIGN PATENT DOCUMENTS

EP 2896392 A2 7/2015
EP 3210586 A1 8/2017

(Continued)

OTHER PUBLICATIONS

Zhou, J, Ergonomic evaluation of brake pedal and push handle locations on hospital beds, Applied Ergonomics, Oct. 21, 2016, p. 305-312, 60.

*Primary Examiner* — David R Hare
*Assistant Examiner* — George Sun
(74) *Attorney, Agent, or Firm* — Price Heneveld LLP

(57) ABSTRACT

A patient support apparatus includes a mattress having a head end. A frame is configured to support the mattress. The frame includes a head portion that extends beyond the head end of the mattress. The head portion defines a recess. At least one handle assembly is pivotally coupled to the head portion. The at least one handle assembly includes an elongate member coupled to the head portion proximate the recess. The elongate member is operable between a stowed position and a deployed position. The elongate member is disposed over the head portion when in the stowed position. A handle extends from a distal end of the elongate member. The handle extends at an acute angle relative to a longitudinal axis of the elongate member.

18 Claims, 5 Drawing Sheets

(56) References Cited

U.S. PATENT DOCUMENTS

| | | | | |
|---|---|---|---|---|
| 7,827,634 | B2 * | 11/2010 | Stroth | A61G 7/08 5/510 |
| 9,027,183 | B2 * | 5/2015 | Childs | A61G 7/0507 5/616 |
| 9,205,009 | B2 | 12/2015 | Koors et al. | |
| 9,233,038 | B2 | 1/2016 | Gibson et al. | |
| 10,004,654 | B2 | 6/2018 | Zerhusen et al. | |
| 2006/0031990 | A1 * | 2/2006 | Palmatier | A61G 1/0212 5/611 |
| 2008/0141459 | A1 * | 6/2008 | Hamberg | A61G 1/0225 5/600 |
| 2010/0138999 | A1 * | 6/2010 | Westmoreland, II | A61G 1/013 5/627 |
| 2015/0231006 | A1 | 8/2015 | Bhimavarapu et al. | |
| 2015/0238264 | A1 | 8/2015 | Kerns et al. | |
| 2016/0008197 | A1 * | 1/2016 | Zerhusen | A61G 7/0513 5/503.1 |
| 2016/0374874 | A1 * | 12/2016 | Trepanier | A61G 1/04 5/611 |
| 2018/0161225 | A1 | 6/2018 | Zerhusen et al. | |

FOREIGN PATENT DOCUMENTS

| | | | |
|---|---|---|---|
| EP | 3182947 | B1 | 5/2019 |
| JP | 2004178933 | A | 1/2006 |

* cited by examiner

HEAD OF BED ACCESS

CROSS-REFERENCE TO RELATED APPLICATION

This application claims priority to and the benefit under 35 U.S.C. § 119(e) of U.S. Provisional Application No. 62/835,266 filed on Apr. 17, 2019, entitled "HEAD OF BEAD ACCESS," the disclosure of which is hereby incorporated herein by reference in its entirety.

FIELD OF THE DISCLOSURE

The present disclosure generally relates to providing increased access to a bed occupant by a caregiver at a head of the bed.

SUMMARY OF THE DISCLOSURE

According to one aspect of the present disclosure, a patient support apparatus includes a mattress having a head end. A frame is configured to support the mattress. The frame includes a head portion that extends beyond the head end of the mattress. The head portion defines a recess. At least one handle assembly is pivotally coupled to the head portion. The at least one handle assembly includes an elongate member coupled to the head portion proximate the recess. The elongate member is operable between a stowed position and a deployed position. The elongate member is disposed over the head portion when in the stowed position. A handle extends from a distal end of the elongate member. The handle extends at an acute angle relative to a longitudinal axis of the elongate member.

According to another aspect of the present disclosure, a patient support apparatus includes a mattress having a head end. A frame is configured to support the mattress. The frame includes a head portion that extends beyond the head end of the mattress. The head portion of the frame defines a recess. Opposing sidewalls of the recess each extend at an oblique angle from a rear wall of the recess. A first handle assembly is pivotally coupled to a first side of the head portion. A second handle assembly is pivotally coupled to a second side of the head portion. Each of the first handle assembly and the second handle assembly are operable between a stowed position and a deployed position.

According to another aspect of the present disclosure, a bed includes a frame configured to support a mattress. The frame includes a head portion configured to extend beyond an end of the mattress. A handle assembly extends from the head portion. The handle assembly includes an elongate member having a base pivotally coupled with the head portion. The elongate member is operable between a stowed position and a deployed position. A handle extends from a distal end of the elongate member. The handle extends from the distal end at an acute angle relative to a longitudinal axis of the elongate member.

These and other features, advantages, and objects of the present invention will be further understood and appreciated by those skilled in the art by reference to the following specification, claims, and appended drawings.

DETAILED DESCRIPTION

Figure 1:
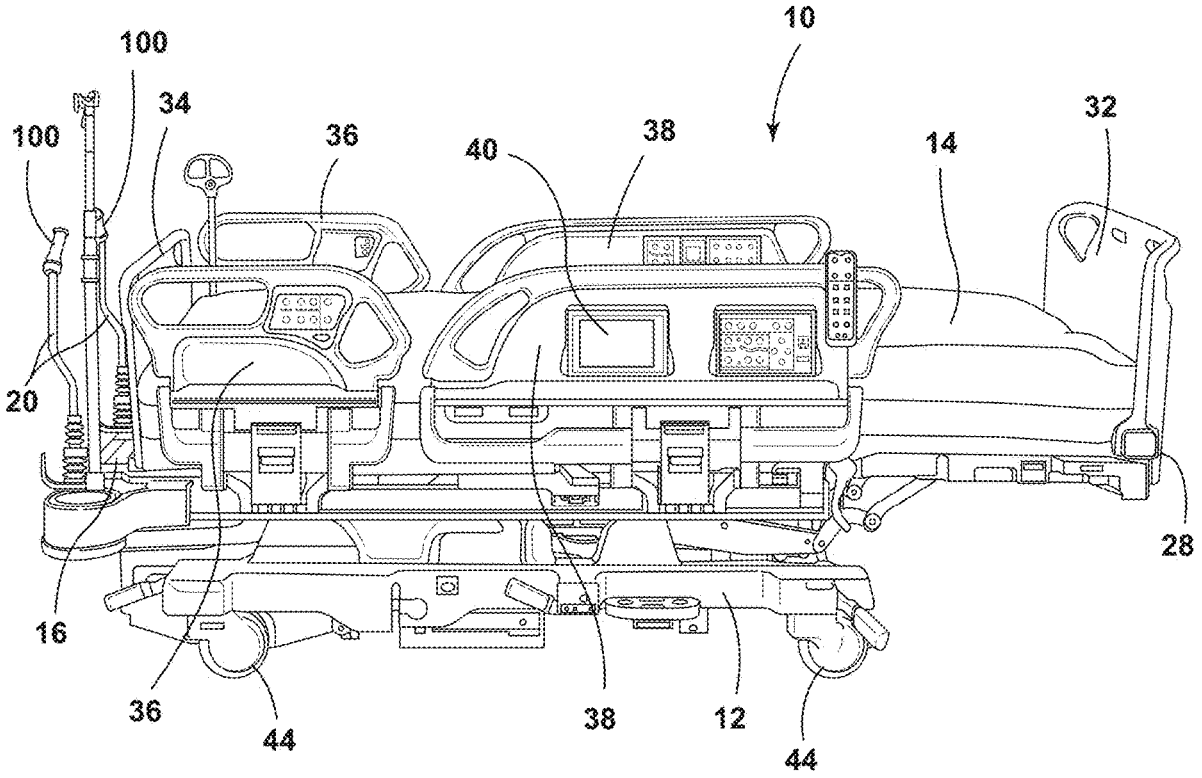
FIG. 1 is a front perspective view of one aspect of a bed of the present disclosure.

The present illustrated embodiments reside primarily in combinations of method steps and apparatus components related to providing increased access to a bed occupant by a caregiver at a head of the bed. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to a surface of the device closest to an intended viewer, and the term "rear" shall refer to a surface of the device furthest from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-6, reference numeral 10 generally designates a bed with a bed frame 12 configured to support a mattress 14. The frame 12 includes a head portion 16 configured to extend laterally beyond a periphery 18 of the mattress 14. At least one handle assembly 20 extends from the head portion 16. The at least one handle assembly 20 includes an elongate member 22 pivotally coupled with the head portion 16 and a handle 24 that extends at an angle $\alpha$ from a distal end 26 of the elongate member 22.

With reference to FIG. 1, the illustrated bed may include a hospital bed. The bed 10 also includes a surface, such as the mattress 14, supported by the frame 12. While described as the bed 10, it is within the scope of the disclosure that the bed 10 may be any patient support apparatus known in the art and may include a patient support structure such as a mattress 14, or any suitable structure for supporting a patient.

As illustrated, the frame 12 of the bed 10 includes the head portion 16 and a foot portion 28. The bed 10 may include a footboard 32 at the foot portion 28 and a headboard 34 at the head portion 16. Furthermore, the bed 10 may include a pair of head side rail assemblies 36 and a pair of foot side rail assemblies 38. In some examples, a graphical user interface 40 is coupled to an external side of at least one side rail of the side rail assemblies 36, 38. The graphical user interface 40 may be configured to accept a user input in order to control functions of the mattress 14 and/or the bed 10. While FIG. 1 illustrates the graphical user interface 40 coupled to the external side of at least one of the side rails of the side rail assemblies 36, 38, it is contemplated that the graphical user interface 40 may be coupled to any suitable component of the bed 10 for access by a user or caregiver. In some examples, the graphical user interface 40 may be coupled to the footboard 32 or the headboard 34.

Figure 2:
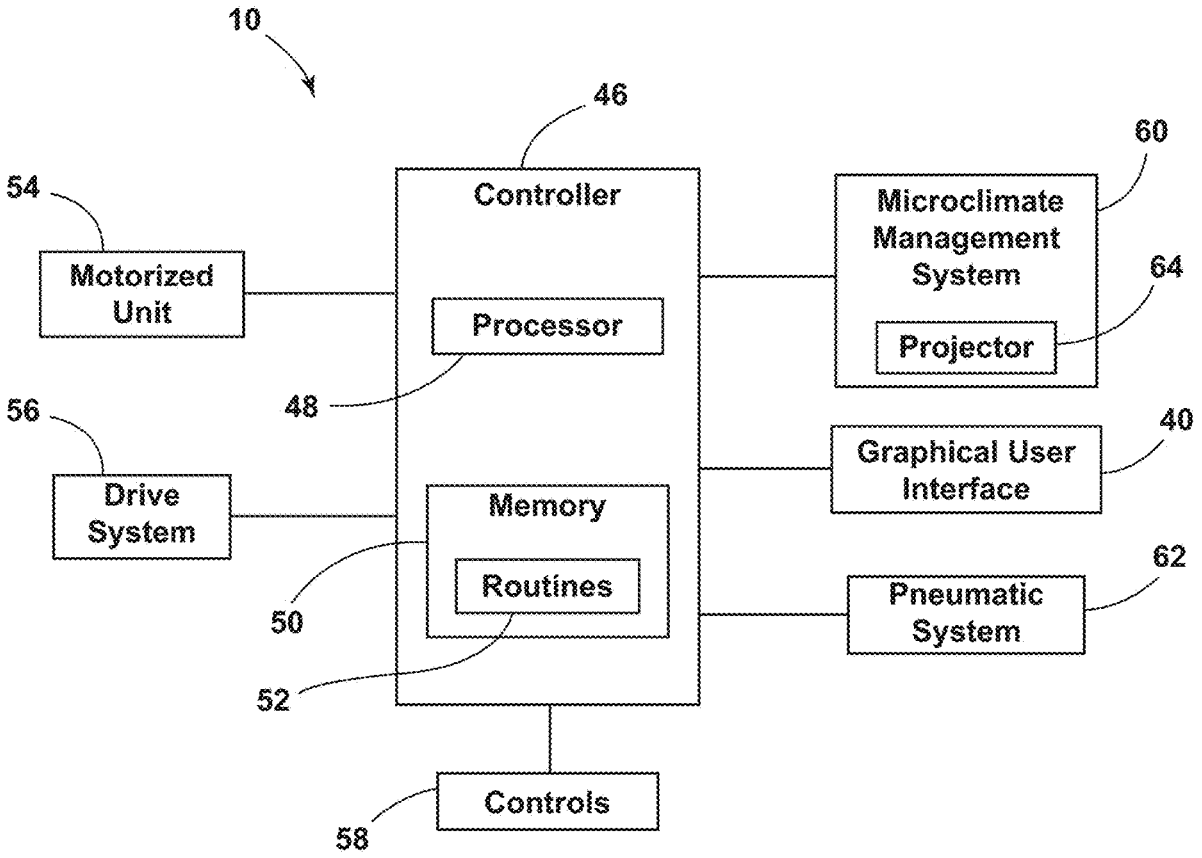
FIG. 2 is a box diagram of a bed of the present disclosure.

With reference to FIGS. 1 and 2, the frame 12 is supported on casters or wheels 44 that engage with an underlying floor surface. The wheels 44 are generally coupled to the frame 12 via an axle. The wheels 44 can be configured to rotate in a power drive mode in order to propel the bed 10 for transportation by a caregiver, medical professional, or other users.

The bed 10 includes a controller 46 having a processor 48, a memory 50, and other control circuitry. Instructions or routines 52 are stored in the memory 50 and executable by the processor 48. The controller 46 may be in communication with various aspects of the bed 10 to communicate control signals. The bed 10 may include a motorized unit 54 operably coupled with a drive system 56 connected with the frame 12. In various aspects, the frame 12 may be operable between raised, lowered, and tilted positions. The handle assembly 20 can include controls 58 for operating the motorized unit 54. The caregiver or other medical professional can input a command through the controls 58, which can be communicated to the controller 46. The controller 46 can send a corresponding signal to control the bed 10 in response to the command.

The bed 10 may include various mattress function technologies, such as a microclimate management (MCM) system 60. The MCM system 60 may address shear, friction, pressure, and moisture properties of the mattress 14 in order to optimize patient comfort and to keep a patient's skin cool and dry, which may aid in the prevention of complications in patient recovery, such as wound prevention. The MCM system 60 may automatically make adjustments based on predetermined therapy functions or manually make adjustments based on user input commands received from the graphical user interface 40. The bed 10 may further include a pneumatic system 62 that provides air for operation of the MCM system 60. Furthermore, the pneumatic system 62 may control airflow in and out of various air bladders or cells of the mattress 14. In some examples, an MCM system status floor indicator may be projected as an image onto the floor surface from a projector 64 coupled with the foot portion 28 of the bed 10 to indicate whether the MCM system 60 is on or off and in what state the MCM system 60 is operating.

Figure 3:
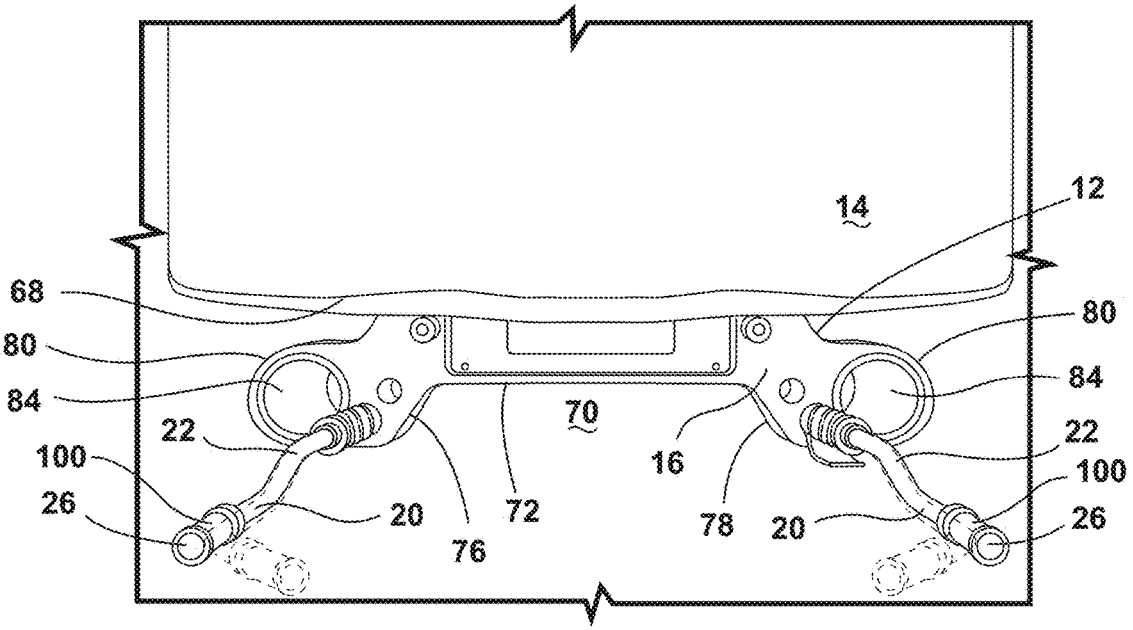
FIG. 3 is a top plan view of a head portion of a bed of the present disclosure.
Figure 4:
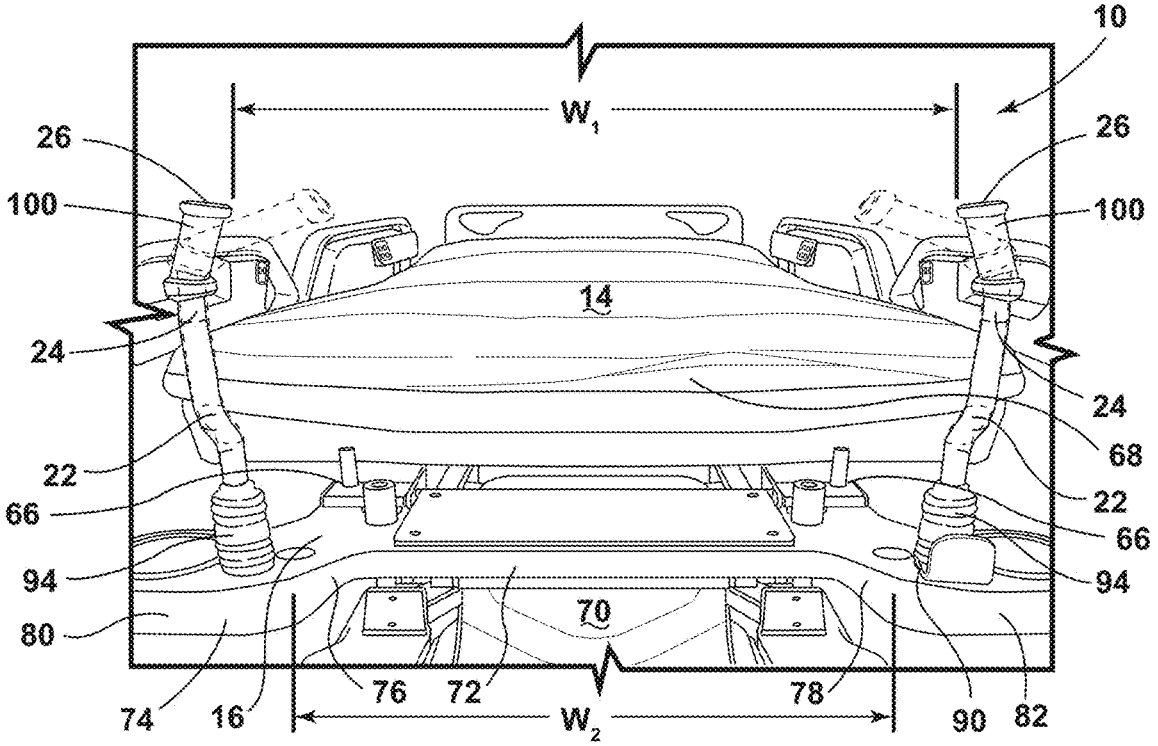
FIG. 4 is a side perspective view of a head portion a bed of the present disclosure.

With reference to FIGS. 1, 3, and 4, the headboard 34 can be selectively engaged with the frame 12. The headboard 34 may be coupled to the head portion 16 of the frame 12, as illustrated in FIG. 1, via retaining brackets 66. The retaining brackets 66 operate to hold the headboard 34 in position on the head portion 16. The headboard 34 can be removed from the frame 12 by a caregiver, as illustrated in FIGS. 3 and 4, to provide greater access to a head area of a patient disposed on the bed 10.

With reference to FIGS. 3 and 4, the mattress 14 includes a head end 68 disposed on the head portion 16 of the frame 12. The head portion 16 of the frame 12 extends beyond the periphery 18 (FIG. 5) of the mattress 14. The head portion 16 is configured to provide an interface between the frame 12 and each handle assembly 20. In some examples, a protective shroud may be placed over portions of the frame 12. The protective shroud may, for example, be positioned between the mattress 14 and the frame 12.

The head portion 16 generally defines a recess 70 configured to provide additional access to the patient by the caregiver. A rear wall 72 of the recess 70 is offset from an outer edge 74 of the frame 12. Opposing sidewalls 76, 78 of the recess 70 extend between the rear wall 72 and the outer edge 74. The opposing sidewalls 76, 78 generally extend at an oblique angle from the rear wall 72, such that the recess 70 defines a trapezoidal-shaped space. A wider space adjacent to the outer edge 74 of the frame 12 relative to the narrower space adjacent to the rear wall 72 of the recess 70 can be advantageous for providing comfort to a caregiver moving within the space. The opposing sidewalls 76, 78 extending at oblique angles can reduce sharp corners where a caregiver moves around to access the patient.

The outer edge 74 is disposed a greater distance from the head end 68 of the mattress 14 relative to the rear wall 72 of the recess 70. In a non-limiting example, the rear wall 72 of the recess 70 may be disposed about 6-inches from the periphery 18 of the head end 68 of the mattress 14. In such examples, the outer edge 74 can be disposed about 9.5-inches from the outer periphery 18 (FIG. 5) of the mattress 14.

As illustrated, the recess 70 is centrally located in the head portion 16 of the frame 12. The recess 70 is generally defined between outwardly extending side projections 80, 82. The side projections 80, 82 each define an aperture 84, which is configured to hold and/or store removable medical supplies, such as, for example, an oxygen tank. The apertures 84 are generally centrally aligned with the rear wall 72 of the recess 70. When the caregiver is standing within the space defined by the recess 70, the caregiver can abut the rear wall 72. Having the apertures 84 with medical supplies aligned with the rear wall 72 can provide greater accessibility to the medical supplies by the caregiver.

Referring still to FIGS. 3 and 4, each handle assembly 20 is configured to rotate downward into abutment or close proximity to the head portion 16 of the frame 12. Each handle assembly 20 includes a base 90 that is secured to the head portion 16. The base 90 is pivotally coupled to the elongate member 22. Generally, the first handle assembly 20 is coupled to the head portion 16 proximate a first side of the recess 70 adjacent the first side projection 80, and the second handle assembly 20 is coupled to the head portion 16 proximate a second opposing side of the recess 70 adjacent the second side projection 82. A protective cover 94 in the form of a polymeric bellows is disposed on the elongate member 22 over a hinge assembly coupling the elongate member 22 with the base 90.

In addition, each handle assembly 20 is operable to rotate or pivot inwardly between a deployed position (FIGS. 3-5), where the elongate member 22 extends generally vertically, normal to a planar extent of a topside of the frame 12, and a stowed position (FIG. 6) where the elongate member 22 and the handle 24 are abutting or in close proximity to the head portion 16. Each handle 24 includes a grip 100 that extends at an acute angle α from the distal end 26 of the elongate member 22. In one example, the grip 100 extends upwardly from the elongate member 22 at a 10 degree angle α relative to a longitudinal axis A defined by the elongate member 22. It will be understood that the grip 100 may extend upwardly from the elongate member 22 at any angle α between 4 degrees and 16 degrees relative to the longitudinal axis A of the elongate member 22.

When the elongate member 22 of the first handle assembly 20 is pivoted downward, the elongate member 22 pivots inwardly at least partially toward the mattress 14, and partially toward the second handle assembly 20. The first handle assembly 20 pivots directly over the head portion 16 of the frame 12. As a result, the additional space provided by the recess 70 is not impinged. The second handle assembly 20 works in a similar fashion to the first handle assembly 20 and rotates inwardly at least partially toward the mattress 14, and partially toward the first handle assembly 20. Once again, the second handle assembly 20 pivots directly over the head portion 16 and does not impinge on the space provided by the recess 70 so that the caregiver has additional space to access an occupant of the bed 10 or to walk behind the bed 10, without the legs of the caregiver striking or hitting the frame.

It will be understood that the grip 100 on each handle 24 of each handle assembly 20 may include a variety of features, including the controls 58 to operate the motorized unit 54 (FIG. 2). The motorized unit 54 can include a motor configured to move the bed 10 in a forward, rearward, or sideways direction. The grip 100 of each handle assembly 20 may include one or more indents 102 (FIG. 6) to accommodate a hand of the user or caregiver. The indents 102 may define outer boundaries for the hand of the user and/or features to form a more ergonomic grasp for the user. In addition, it will be understood that when in the upright, deployed position, each handle assembly 20 affords a substantial width of space $W_1$ that is equal to or greater than a width of the space $W_2$ defined by the recess 70 of the head portion 16.

Figure 5:
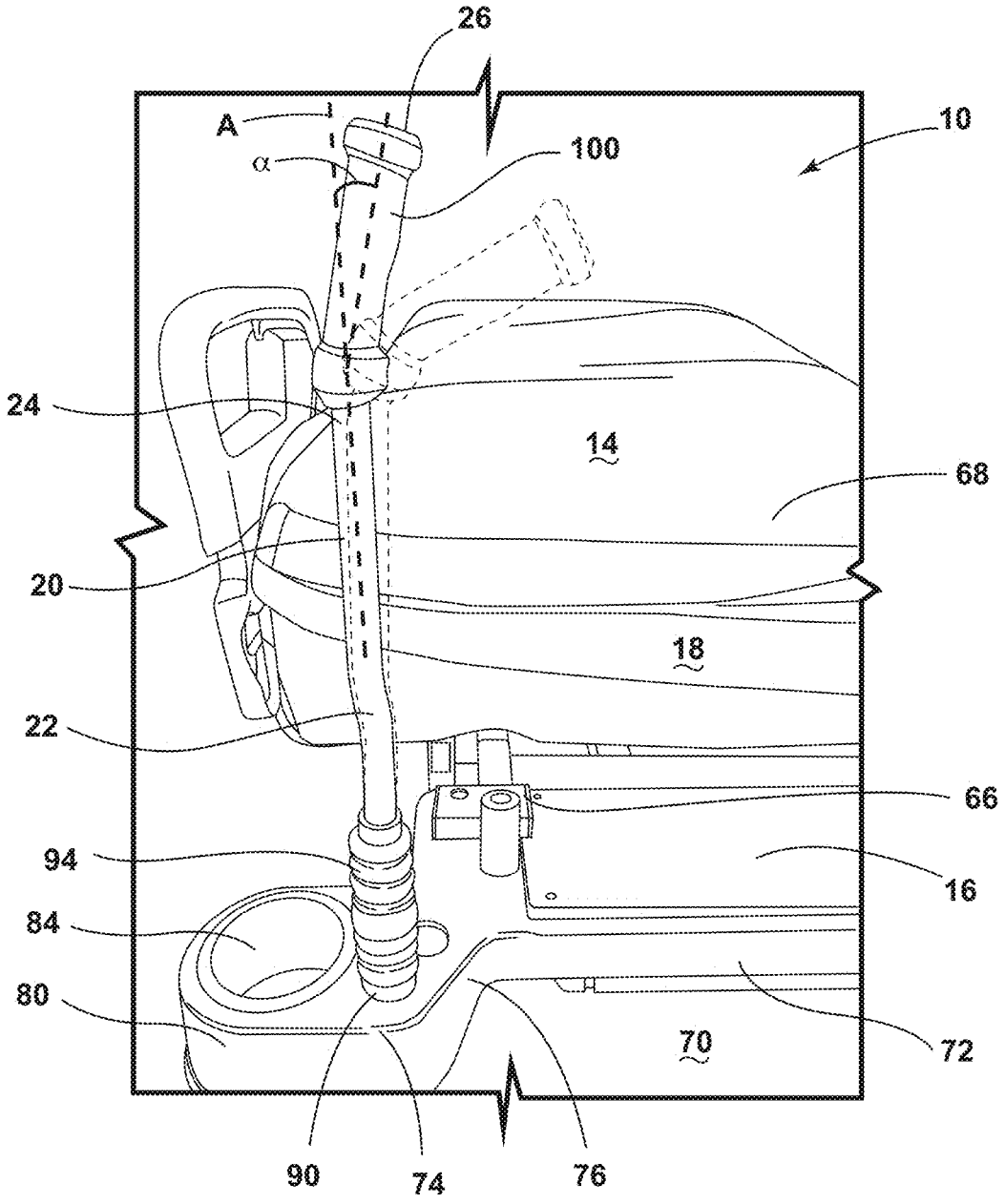
FIG. 5 is a partial side perspective view of a bed having a handle assembly of the present disclosure.

With regard to FIG. 5, the grip 100 is illustrated extending at a 10 degree angle α relative to the longitudinal axis A of the elongate member 22. It will be understood that the grip 100 may extend at any angle α between 4 degrees and 16 degrees relative to the longitudinal axis A of the elongate member 22. It will also be noted that the grip 100 may be constructed of a polymeric high friction material, such as Santoprene™, that is easily graspable by the caregiver. The elongate member 22 is generally defined by a tubular pole configured to house power and possibly data lines, which is advantageous when the handle assembly 20 includes the controls 58 (FIG. 2). However, the elongate member 22 could take on other constructions and shapes.

Figure 6:
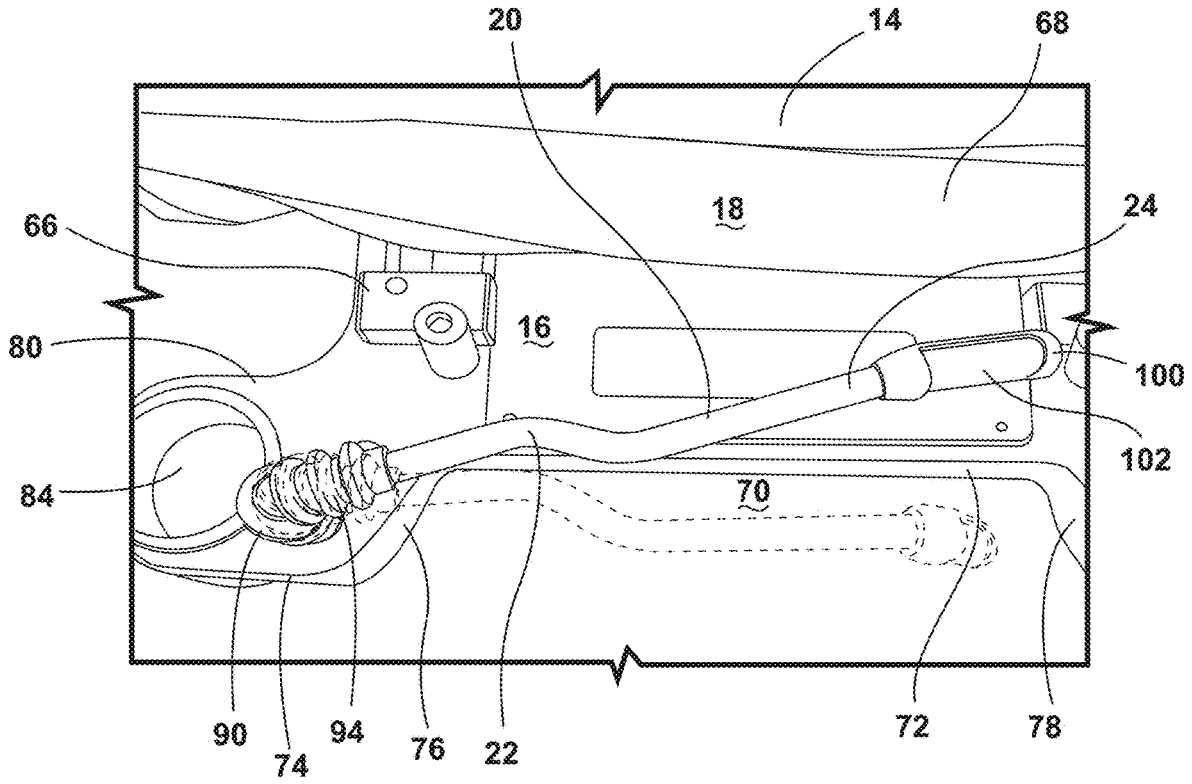
FIG. 6 is a top perspective view of a handle assembly for a bed, with the handle assembly in a stowed position.

Referring to FIGS. 5 and 6, the handle assembly 20 is operable between the deployed position (FIG. 5) and the stowed position (FIG. 6). When in the deployed position, the handle assembly 20 extends vertically from the head portion 16 of the frame 12. It may be beneficial for the user to push the handle assemblies 20 when the handle assemblies 20 are in the deployed position. The handle assemblies 20 can provide an ergonomic posture for pushing the bed 10.

When the elongate member 22 is rotated downward against, or in close proximity to, the head portion 16 of the frame 12, the elongate member 22 and the grip 100 do not extend into the space defined by the recess 70. Rather, each handle assembly 20 rotates inwardly and slightly toward the mattress 14. Each handle assembly 20 pivots directly over the head portion 16 of the frame 12. When in the stowed position, the elongate member 22 and the grip 100 extend between the rear wall 72 of the recess 70 and the head end 68 of the mattress 14.

When in the stowed position, the handle assembly 20 can extend at an acute angle relative to the outer edge 74 of the frame 12. In a specific non-limiting example, the handle assembly 20 and the outer edge 74 of the frame 12 can define an angle of 19 degrees. However, it is contemplated that the handle assembly 20 can extend at any angle between about 15 degree and about 25 degrees relative to the outer edge 74 of the frame 12. The angled-orientation of the handle assembly 20 can prevent the handle assembly 20 from impeding on the space defined by the recess 70 when in the deployed position, the stowed position, and when pivoting therebetween. Accordingly, the caregiver has increased access to an occupant of the bed 10 when each handle assembly 20 is in the deployed position and in the stowed position.

Use of the present device may provide for a variety of advantages. For example, the frame 12 defines the recess 70 in the head portion 16 to provide greater access to a head area of the patient on the bed 10. Further, the opposing sidewalls 76, 78 of the recess 70 extend at an oblique angle from the rear wall 72 of the recess 70 to provide increased comfort for the caregiver. Additionally, the grip 100 can extend at an acute angle α from the distal end 26 of the elongate member 22 relative to the longitudinal extent of the elongate member 22. The angle α of the grip 100 can prevent the grip 100 from impinging the space defined by the recess 70. Moreover, each handle assembly 20 can extend at an acute angle relative to the outer edge 74 of the frame 12 when in the stowed position. The angle of the elongate member 22 can prevent the handle assembly 20 from impinging the space defined by the recess 70. Accordingly, the handle assembly 20 can pivot directly over the head portion 16 of the frame 12 and extend between the rear wall 72 of the recess 70 and the head end 68 of the mattress 14. These and other benefits or advantages can also be realized and/or achieved.

According to at least one aspect of the present disclosure, a patient support apparatus includes a mattress having a head end. A frame is configured to support the mattress. The frame includes a head portion that extends beyond the head end of the mattress. The head portion defines a recess. At least one handle assembly is pivotally coupled to the head portion. The at least one handle assembly includes an elongate member coupled to the head portion proximate the recess. The elongate member is operable between a stowed position and a deployed position. The elongate member is disposed over the head portion when in the stowed position. A handle extends from a distal end of the elongate member. The handle extends at an acute angle relative to a longitudinal axis of the elongate member.

According to another aspect, at least one handle assembly extends between a recess and a head end when in a stowed position.

According to another aspect, at least one handle assembly includes a first handle assembly coupled to a head portion on a first side of a recess and a second handle assembly coupled to the head portion on a second side of the recess.

According to another aspect, an elongate member of each of a first handle assembly and a second handle assembly pivots directly over a head portion.

According to another aspect, a handle of each of a first handle assembly and a second handle assembly includes controls to operate a motorized unit operably coupled with a drive system connected with a frame.

According to another aspect, a handle extends at an acute angle between 4 degrees and 16 degrees relative to the longitudinal axis of an elongate member.

According to another aspect, an elongate member extends over the head portion at an acute angle between 15 degrees and 25 degrees relative to an outer edge of a frame.

According to another aspect of the present disclosure, a patient support apparatus includes a mattress having a head end. A frame is configured to support the mattress. The frame includes a head portion that extends beyond the head end of the mattress. The head portion of the frame defines a recess. Opposing sidewalls of the recess each extend at an oblique angle from a rear wall of the recess. A first handle assembly is pivotally coupled to a first side of the head portion. A second handle assembly is pivotally coupled to a second side of the head portion. Each of the first handle assembly and the second handle assembly are operable between a stowed position and a deployed position.

According to another aspect, each of a first handle assembly and a second handle assembly includes an elongate member and a handle. The handle extends at an acute angle relative to a longitudinal axis of the elongate member, respectively.

According to another aspect, an acute angle is between 4 degrees and 16 degrees relative to a longitudinal axis of an elongate member, respectively.

According to another aspect, a recess is centrally located between side projections. The side projections each define an aperture configured to store removable medical supplies.

According to another aspect, each of a first handle assembly and a second handle assembly pivot directly over a head portion.

According to another aspect, each of a first handle assembly and a second handle assembly extend between a rear wall of a recess and a head end of a mattress when in a stowed position.

According to another aspect, each of a first handle assembly and a second handle assembly extends over a head portion at an acute angle between 15 degrees and 25 degrees relative to an outer edge of a frame when in a stowed position.

According to another aspect of the present disclosure, a bed includes a frame configured to support a mattress. The frame includes a head portion configured to extend beyond an end of the mattress. A handle assembly extends from the head portion. The handle assembly includes an elongate member having a base pivotally coupled with the head portion. The elongate member is operable between a stowed position and a deployed position. A handle extends from a distal end of the elongate member. The handle extends from the distal end at an acute angle relative to a longitudinal axis of the elongate member.

According to another aspect, a head portion defines a centrally located recess.

According to another aspect, a recess is defined by a rear wall and opposing sidewalls. The opposing sidewalls each extend at an oblique angle from the rear wall.

According to another aspect, an elongate member and a handle extend over a head portion of a frame between a recess and an end of a mattress when in a stowed position.

According to another aspect, an elongate member pivots directly over a head portion.

According to another aspect, a handle assembly extends at an angle between 15 degrees and 25 degrees relative to an outer edge of a frame when in a stowed position.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure, as shown in the exemplary embodiments, is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts, or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A patient support apparatus, comprising:

a mattress having a head end;

a frame configured to support the mattress, wherein the frame includes a head portion that extends beyond the head end of the mattress, and wherein the head portion includes a rear wall and opposing sidewalls that define a recess extending into the frame toward the mattress and providing a space for a caregiver; and at least one handle assembly pivotally coupled to the head portion, wherein the at least one handle assembly includes:

an elongate member coupled to the head portion proximate the recess, wherein the elongate member is operable between a stowed position and a deployed position, and wherein the elongate member is disposed over the head portion when in the stowed position; and a handle extending from a distal end of the elongate member, wherein the handle extends at an acute angle relative to a longitudinal axis of the elongate member, and wherein the recess is free of the at least one handle assembly when the at least one handle assembly is in the stowed position.

2. The patient support apparatus of claim 1, wherein the at least one handle assembly extends between the rear wall and the head end when in the stowed position.

3. The patient support apparatus of claim 1, wherein the at least one handle assembly includes a first handle assembly coupled to the head portion on a first side of the recess and a second handle assembly coupled to the head portion on a second side of the recess.

4. The patient support apparatus of claim 3, wherein the elongate member of each of the first handle assembly and the second handle assembly pivots directly over the head portion.

5. The patient support apparatus of claim 3, wherein the handle of each of the first handle assembly and the second handle assembly includes controls to operate a motorized unit operably coupled with a drive system connected with the frame.

6. The patient support apparatus of claim 1, wherein the handle extends at the acute angle between 4 degrees and 16 degrees relative to the longitudinal axis of the elongate member.

7. The patient support apparatus of claim 1, wherein the elongate member extends over the head portion at an acute angle between 15 degrees and 25 degrees relative to an outer edge of the frame.

8. A patient support apparatus, comprising:

a mattress having a head end;

a frame configured to support the mattress, wherein the frame includes a head portion that extends beyond the head end of the mattress, wherein the head portion of the frame defines a recess, and wherein opposing sidewalls that define the recess each extends at an oblique angle from a rear wall that defines the recess, the recess extending into the frame toward the mattress to provide a space for a caregiver;

a first handle assembly pivotally coupled to a first side of the head portion; and a second handle assembly pivotally coupled to a second side of the head portion, wherein each of the first handle assembly and the second handle assembly are operable between a stowed position and a deployed position, wherein each of the first handle assembly and the second handle assembly is disposed over the head portion and extends between the rear wall and the head end when in the stowed position.

9. The patient support apparatus of claim 8, wherein each of the first handle assembly and the second handle assembly includes an elongate member and a handle, and wherein the handle extends at an acute angle relative to a longitudinal axis of the elongate member, respectively.

10. The patient support apparatus of claim 9, wherein the acute angle is between 4 degrees and 16 degrees relative to the longitudinal axis of the elongate member, respectively.

11. The patient support apparatus of claim 8, wherein the recess is centrally located between curved side projections that extend laterally outward from the head portion, and wherein the curved side projections each define an aperture configured to store removable medical supplies.

12. The patient support apparatus of claim 8, wherein each of the first handle assembly and the second handle assembly pivot directly over the head portion.

13. The patient support apparatus of claim 8, wherein the recess is free of the first handle assembly and the second handle assembly when at least one of the first handle assembly and the second handle assembly is in the stowed position.

14. The support apparatus of claim 8, wherein each of the first handle assembly and the second handle assembly extends over the head portion at an acute angle between 15 degrees and 25 degrees relative to an outer edge of the frame when in the stowed position.

15. A bed, comprising:

a frame configured to support a mattress, wherein the frame includes a head portion configured to extend beyond an end of the mattress, and wherein the head portion of the frame includes curved projections extending laterally outward from the head portion and disposed on opposing sides of a centrally located recess, wherein the centrally located recess is defined by a rear wall and opposing sidewalls that each extend at an oblique angle from the rear wall, and wherein the centrally located recess extends into the frame toward the mattress to provide a space for a caregiver; and a handle assembly extending from the head portion, wherein the handle assembly includes:

an elongate member having a base pivotally coupled with the head portion, wherein the elongate member is operable between a stowed position and a deployed position; and a handle extending from a distal end of the elongate member, wherein the handle extends from the distal end at an acute angle relative to a longitudinal axis of the elongate member.

16. The bed of claim 15, wherein the elongate member and the handle extend over the head portion of the frame between the centrally located recess and the end of the mattress when in the stowed position.

17. The bed of claim 15, wherein the elongate member pivots directly over the head portion.

18. The bed of claim 15, wherein the handle assembly extends at an angle between 15 degrees and 25 degrees relative to an outer edge of the frame when in the stowed position.

* * * * *